United States Patent [19]

Vener

[11] Patent Number: 4,592,270

[45] Date of Patent: Jun. 3, 1986

[54] SMOKE AND FIRE PROTECTION SYSTEM FOR ELEVATORS

[76] Inventor: Alvin S. Vener, 6116 Skyline, Houston, Tex. 77057

[21] Appl. No.: 631,256

[22] Filed: Jul. 16, 1984

[51] Int. Cl.[4] ..... F24F 11/00

[52] U.S. Cl. ..... 98/39.1; 98/115.4; 187/1 R

[58] Field of Search ..... 98/33 R, 39, 115 VM; 187/1 R; 137/580

[56] References Cited

U.S. PATENT DOCUMENTS

| | | | |
|---|---|---|---|
| 3,817,161 | 6/1974 | Koplon | 98/39 |
| 3,913,470 | 10/1975 | Cullen | 98/115 VM |
| 4,072,355 | 2/1978 | Pentith | 137/580 X |
| 4,233,889 | 11/1980 | Hederman | 98/115 VM |

FOREIGN PATENT DOCUMENTS

| | | | |
|---|---|---|---|
| 2246043 | 3/1974 | Fed. Rep. of Germany | 98/115 VM |
| 54-104151 | 8/1979 | Japan | 187/1 R |

OTHER PUBLICATIONS

John H. Klote, P.E., "Smoke Control for Elevators", *Ashrae Journal,* Vol. 26, No. 4, Apr. 1984, pp. 23–33.

Boggarm S. Setty, P.E., "Fire and Smoke Control in Multiuse Facilities", *Heating/Piping/Air Conditioning,* Apr. 1984, pp. 57–63.

*Primary Examiner*—Harold Joyce

*Attorney, Agent, or Firm*—Neal J. Mosely

[57] ABSTRACT

A smoke and fire protection system is disclosed for elevators in a multistory building having an elevator hoistway therein, with an elevator cab having vertical movement therein. The hoistway is preferably enclosed at the top to prevent discharge of smoke therethrough. A duct is positioned in the hoistway connected to the elevator cab throughout its entire range of vertical movement and has an elongated opening extending for the full height thereof and sealed by a pair of elongated strips of flexible material along each edge of the opening meeting in sealing relation. A duct of elongated cross section and bell shaped is secured on the cab and fits through the sealing strips at the point of contact therebetween for movement with the cab along the length of the elongated opening with the sealing strips maintaining sealing relation ahead of and behind the elongated bell shaped portion. A blower connected to the duct supplies fresh air to the elevator cab and may include heating, cooling, and filtering apparatus for conditioning the air supplied therethrough. The blower supplies fresh air at a volume and pressure sufficient to ventilate the cab and effect a substantial outflow of air on opening the elevator and hoistway doors.

15 Claims, 12 Drawing Figures

FIG. 6
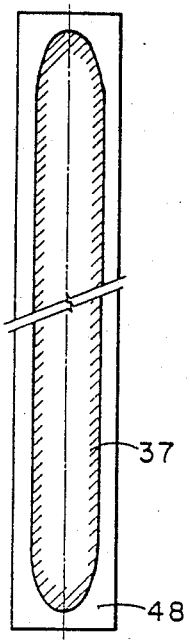
FIG. 7
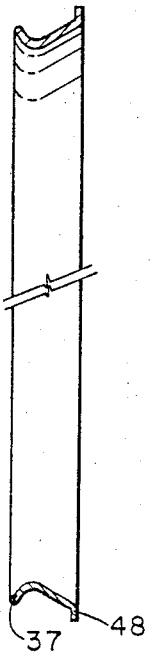
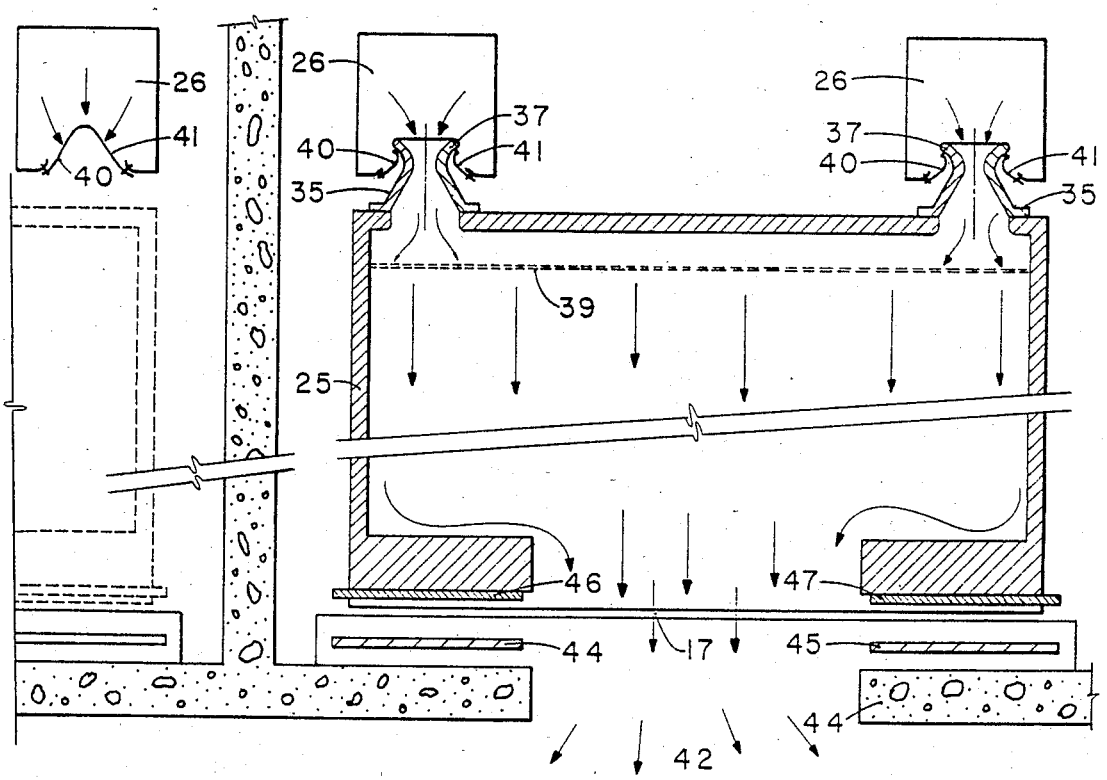
FIG. 8

SMOKE AND FIRE PROTECTION SYSTEM FOR ELEVATORS

BACKGROUND OF THE INVENTION

1. Field of the Invention

This invention relates to new and useful improvements in systems for permitting the use of elevators during a building fire.

2. Description of the Prior Art

In most elevators lobbies in the United States, there are signs warning against the use of elevators in the event of fire and directing the building occupants to use marked exits stairways. The National Fire Protection Association (NFPA), Life Safety Code lists the following problems involved with the use of elevators as fire exits:

If an elevator call button has been pushed at that level, an automatic elevator may stop automatically at the floor involved in the fire and open automatically, thus exposing occupants to fire and smoke.

A large number of people attempting to crowd into an elevator in case of fire might prevent the doors from closing and make it impossible for the elevator to start.

If electric supply cables are damaged during a fire, the elevators may be rendered inoperative and trap occupants in elevators stopped between floors. There might not be time to permit rescue of trapped occupants through emergency escape hatches or doors.

Persons seeking to escape from a fire by means of a elevator may have to wait at the elevator door for some time, during which they may be exposed to fire, smoke or developing panic.

In most multistory buildings, the elevators are set to descend automatically to the ground floor in the event of fire. Fire fighters have keys to control elevators manually during building evacuation and fire fighting.

Since smoke infiltration into elevator shafts frequently threatens lives and hinders elevator use by fire fighters, it is current practice in some buildings to provide top vents in elevator shafts serving more than three floors to allow the elevator shaft to act as a smoke shaft carrying smoke from the fire floor out of the building. Because of leakage around elevator doors, however, this feature may contribute significantly to smoke movement beyond the fire floor by way of elevator shaft itself.

Several suggestions have been made to permit the utilization of elevators in buildings during fires. The use of elevators may be needed for the evacuation of physically handicapped persons who can not walk down the stairways. The elevators may also be needed for the use of fire protection or fire control personal.

One of the proposals for assisting in the evacuation of buildings is seen in Heba U.S. Pat. No. 3,952,452 which discloses the use of a blower to pressurize stairwells to keep out fire and smoke and to assist in the opening of doors which might otherwise be held shut by a pressurize differential. In Koplon U.S. Pat. No. 3,817,161 a system is shown wherein the elevator shaft or hoistway is pressurized by a blower to keep the shaft free of smoke and reduce the hazard of suffocation. The elevator is also designed for drawing air from the hoistway to discharge into any given floor through the open elevator doors to clear smoke from that level.

ASHRAE journal, April 1984, pp.23–33, discusses at length the problem of smoke control for elevators which need to be used during a fire either for evacuation of building occupants or for use by fire department personnel. Heating-Piping-Air Conditioning, April 1984 includes several articles dealing with smoke control in multistory buildings.

The foregoing references do not suggest the concept of this invention, viz., the continuous pressurizing of an elevator cab to permit its use during a fire for building evacuation or for use by fire department personal.

SUMMARY OF THE INVENTION

One of the objects of this invention is to provide a new and improved system, apparatus and method for protecting elevators from fire and smoke to permit their use during fires.

Another object of the invention is to provide an elevator system having having means for ventilating an elevator cab during its entire range of vertical movement.

Another object of the invention is to provide an elevator system having a ventilator duct flexibly connected to an elevator cab to supply fresh air in high volume and at a positive pressure to prevent inflow of smoke when the doors are closed and to flow outward to clear the smoke away when the doors are opened.

Still another object of the invention is to provide an elevator system having a ventilator duct extending vertically for the entire length of the hoistway with a continuous connection to the elevator cab to supply fresh air in high volume and at a positive pressure to prevent inflow of smoke when the doors are closed and to flow outward to clear the smoke away when the doors are opened.

Other objects of the invention will become apparent from time to time throughout the specification and claims as hereinafter related.

The foregoing objects and other objects of the invention are accomplished by a novel smoke and fire protection system for elevators in a multistory building having an elevator hoistway therein, with an elevator cab having vertical movement therein. The hoistway is preferably enclosed at the top to prevent discharge of smoke therethrough. A duct is positioned in the hoistway connected to the elevator cab throughout its entire range of vertical movement and has an elongated opening extending for the full height thereof and sealed by a pair of elongated strips of flexible material along each edge of the opening meeting in sealing relation. A duct of elongated cross section and bell shaped is secured on the cab and fits through the sealing strips at the point of contact therebetween for movement with the cab along the length of the elongated opening with the sealing strips maintaining sealing relation ahead of and behind the elongated bell shaped portion. A blower connected to the duct supplies fresh air to the elevator cab and may include heating, cooling, and filtering apparatus for conditioning the air supplied therethrough. The blower supplies fresh air at a volume and pressure sufficient to ventilate the cab and effect a substantial outflow of air on opening the elevator and hoistway doors.

BRIEF DESCRIPTION OF THE DRAWINGS

FIG. 6 is a view in longitudinal section of the transfer duct shown in FIGS. 5 and 8.

FIG. 7 is a view in longitudinal central section of the transfer duct shown in FIG. 6.

FIG. 8 is a view in horizontal section at the elevator lobby level showing the elevator cab and its connection to the ventilating system.

DESCRIPTION OF THE PREFERRED EMBODIMENTS

Figure 1:
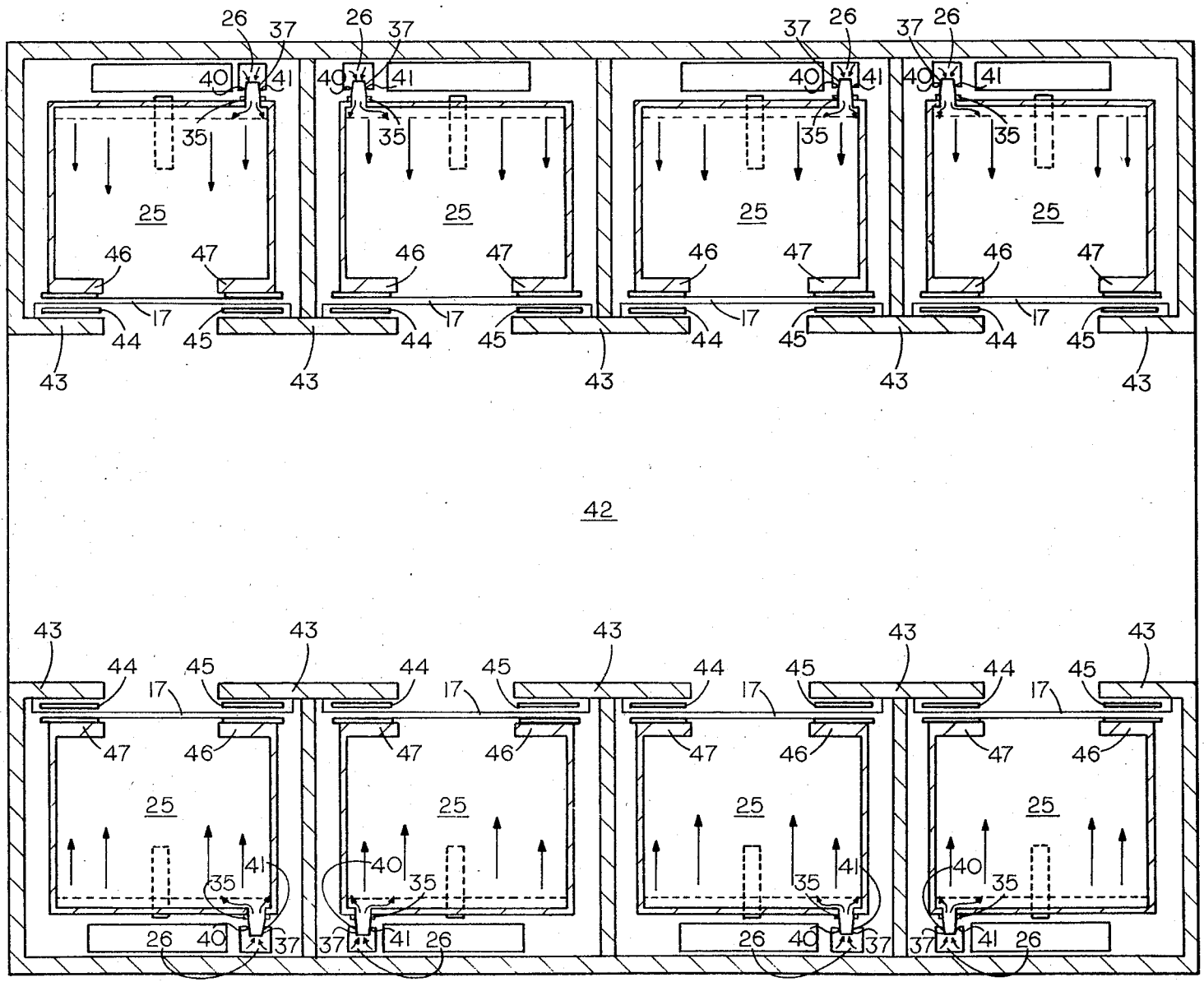
FIG. 1 is a plan view, partially in section, of a building lobby and a bank of elevators illustrating a preferred embodiment of this invention.
Figure 2:
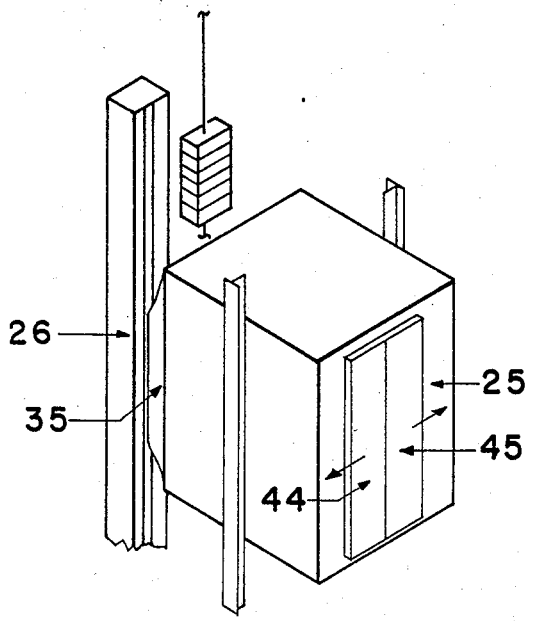
FIG. 2 is an isometric view of an elevator cab showing its connection to a ventilation system in accordance with this invention.
Figure 4:
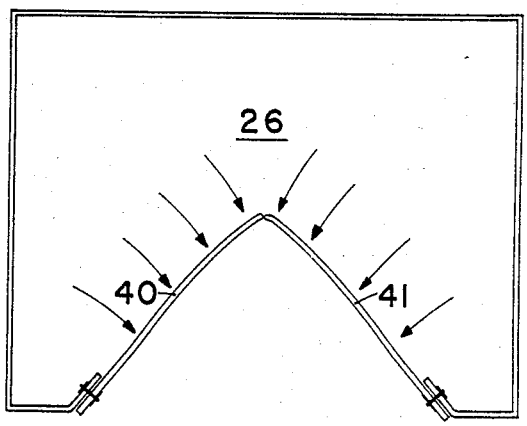
FIG. 4 is a horizontal section through the vertical ventilating duct in the elevator hoistway showing the longitudinal seals in a closed position.
Figure 5:
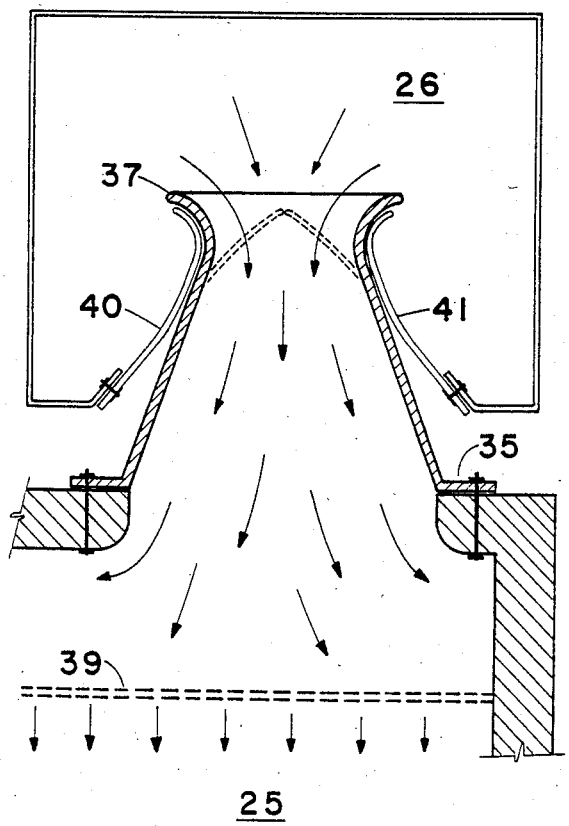
FIG. 5 is a horizontal section through the vertical ventilating duct in the elevator hoistway showing the transfer duct from the elevator cab extending through the seals.

Referring to the drawings by numerous of reference, and more particularly to FIG. 3, there is shown a multistory building 10 having a basement level 11 below the surface 12 of the earth and having a plurality of levels 13, 14, 15, and 16. The building may have any number of floors but the application of the invention is normally used with buildings having three or more floors.

Building 10 has a hoistway or elevator shaft 17 which extends from a closed bottom 18 at the level of the basement 11 to a closed top 19 adjacent to the roof 20 of the building. The building has doorways 21 at each level which open into a stairwell (not shown). The stairwell opens at the top into a roof enclosure 22 in which there is positioned the hoist mechanism 23 which operates the elevator. Hoist mechanism is shown as operating a cable 24 which is connected to a elevator cab 25.

A vertically extending air supply duct 26 extends for the entire height of hoistway or elevator shaft 17. Air supply duct 26 has a plurality of outlet openings 27 which discharge air from the air supply duct 26 into hoistway 17 and an outlet opening 28 which discharges air into the roof enclosure 22 for the elevator motor. Air may also enter the hoistway 17 by leakage around the connection to the elevator cab as described below.

The building is supplied with one or more air supplies leading to the vertical supply air duct 26. In FIG. 3, there are shown two such air supplies, although any suitable number could be used according to the needs of a building of a given height. The lower air supply duct 29 opens into vertical air supply duct 26 as indicated at 40. Air supply duct 29 is connected through an enlarged housing 31 which contains a high capacity blower 32 and which opens through an air inlet 33 to the exterior of the building. The upper air supply is the same as the lower air supply but has the supply duct 29 shown in two parts with a heating and/or cooling section 44 installed therein.

Figure 3:
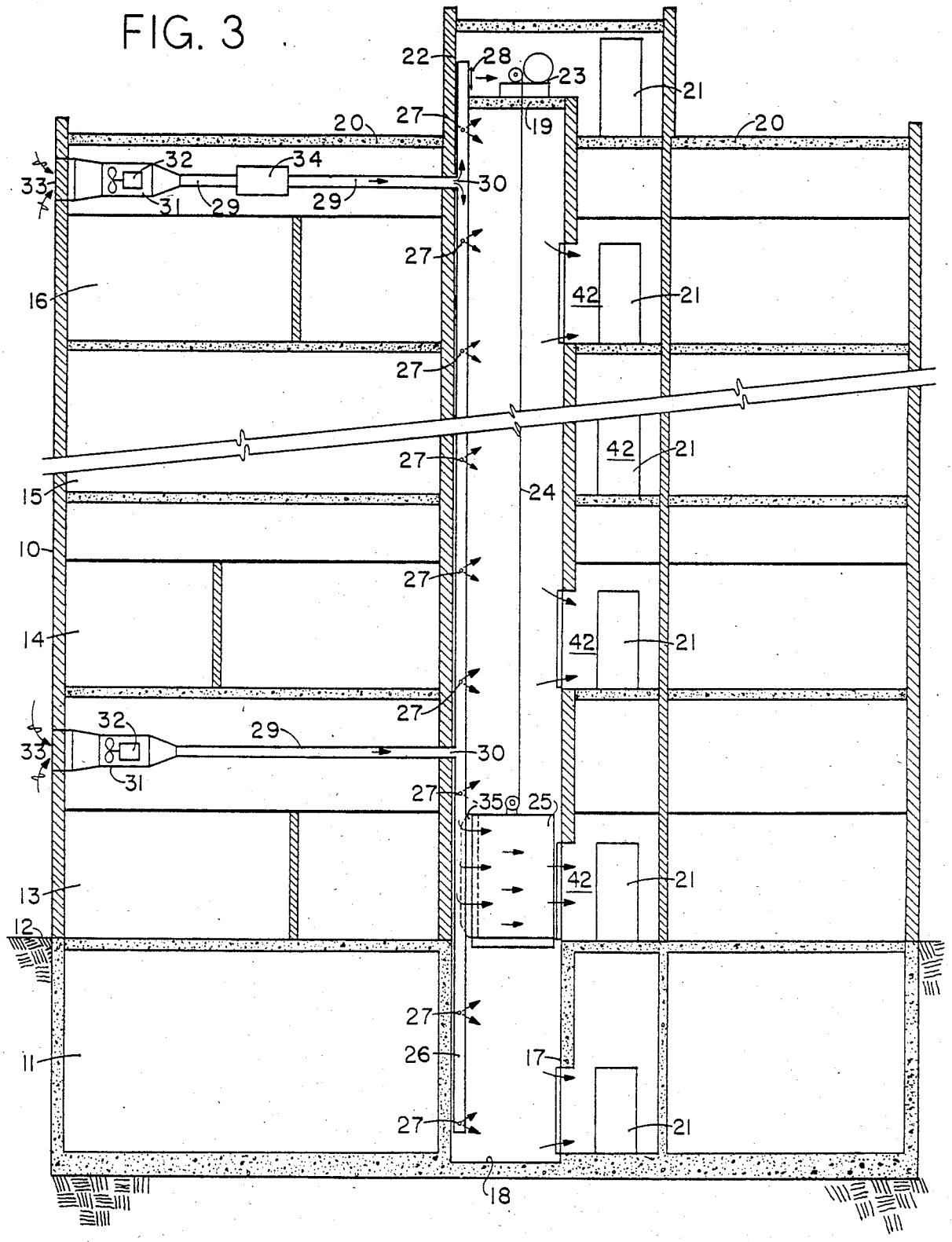
FIG. 3 is a partially schematic, vertical section through a multistory building showing the elevator cab and hoistway and regulating system comprising a preferred embodiment of this invention.

The elevator cab 25 is provided with a transfer duct 35, shown schematically in FIG. 3, which cooperates with vertical air supply duct 26 to conduct fresh air under pressure into the interior of the cab to ventilate the cab and maintain the air under a somewhat elevated pressure to prevent smoke and flames from entering the cab either from the hoistway 17 or from the elevator lobby on any level where the elevator door opened.

Figure 9:
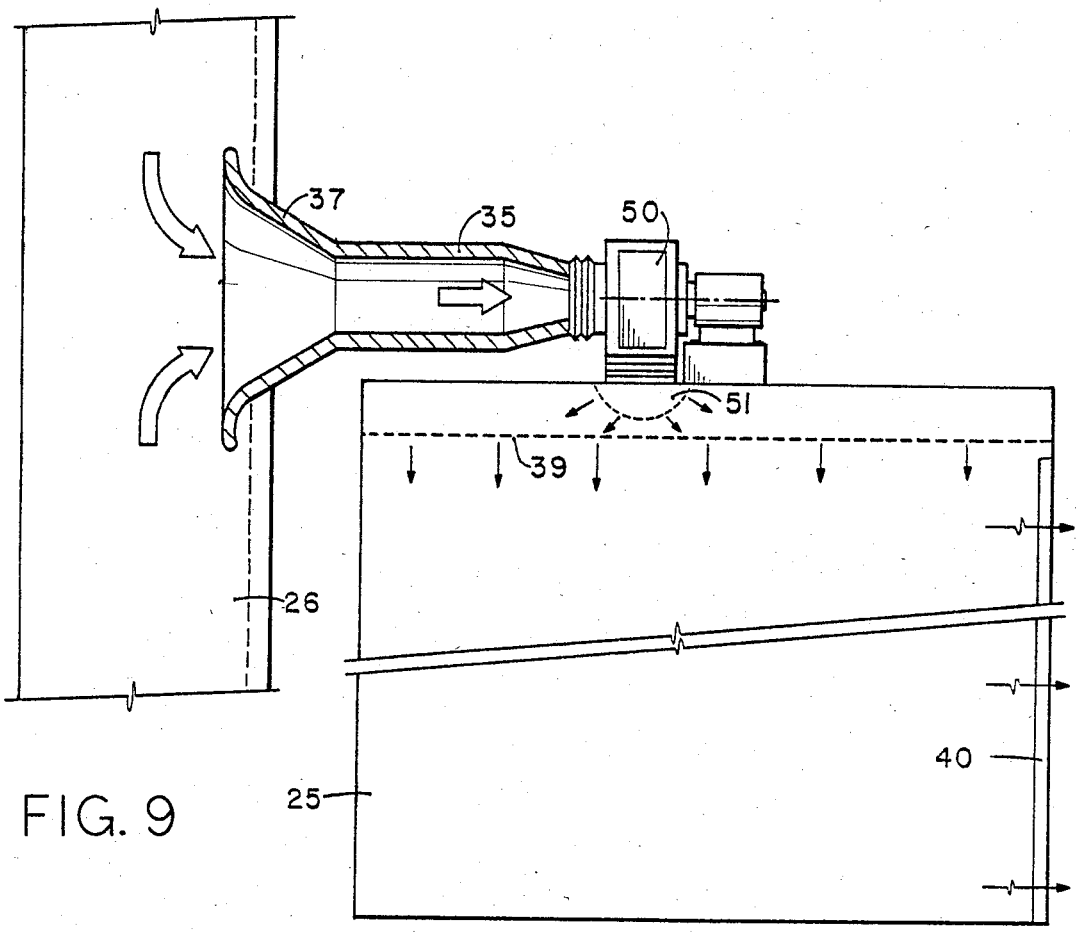
FIG. 9 is a vertical section through the elevator cab illustrating the connection between the cab and a pressurized air supply duct for continuous ventilation during operation of the elevator.
Figure 10:
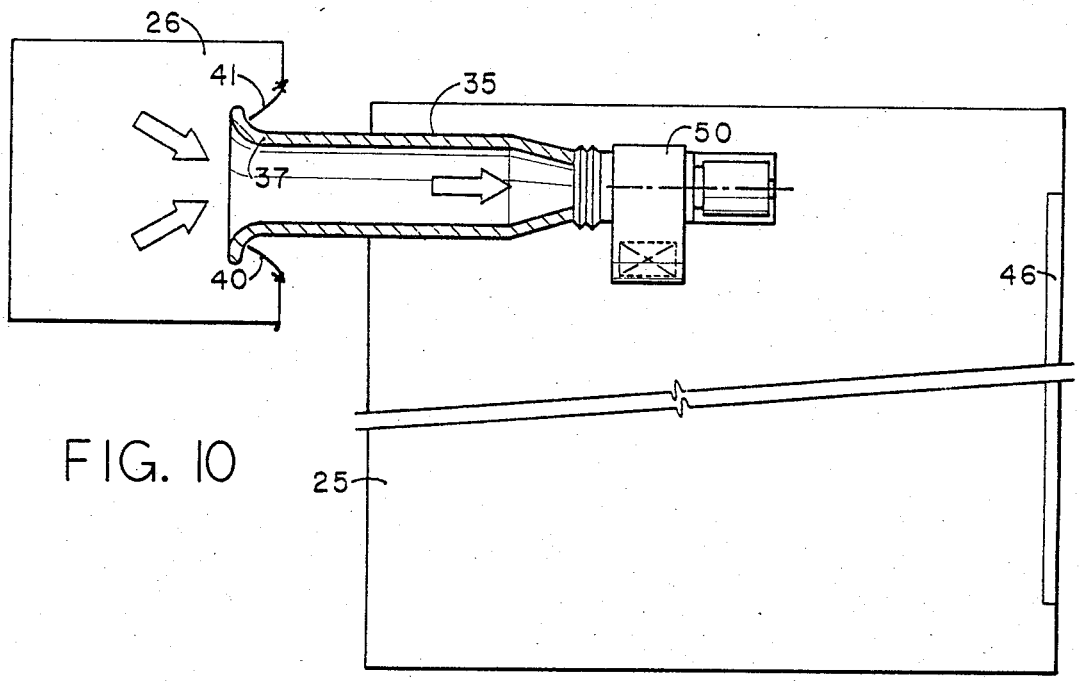
FIG. 10 is a roof plan view of the elevator cab of FIG. 9 showing the air supply connection in horizontal section.
Figure 11:
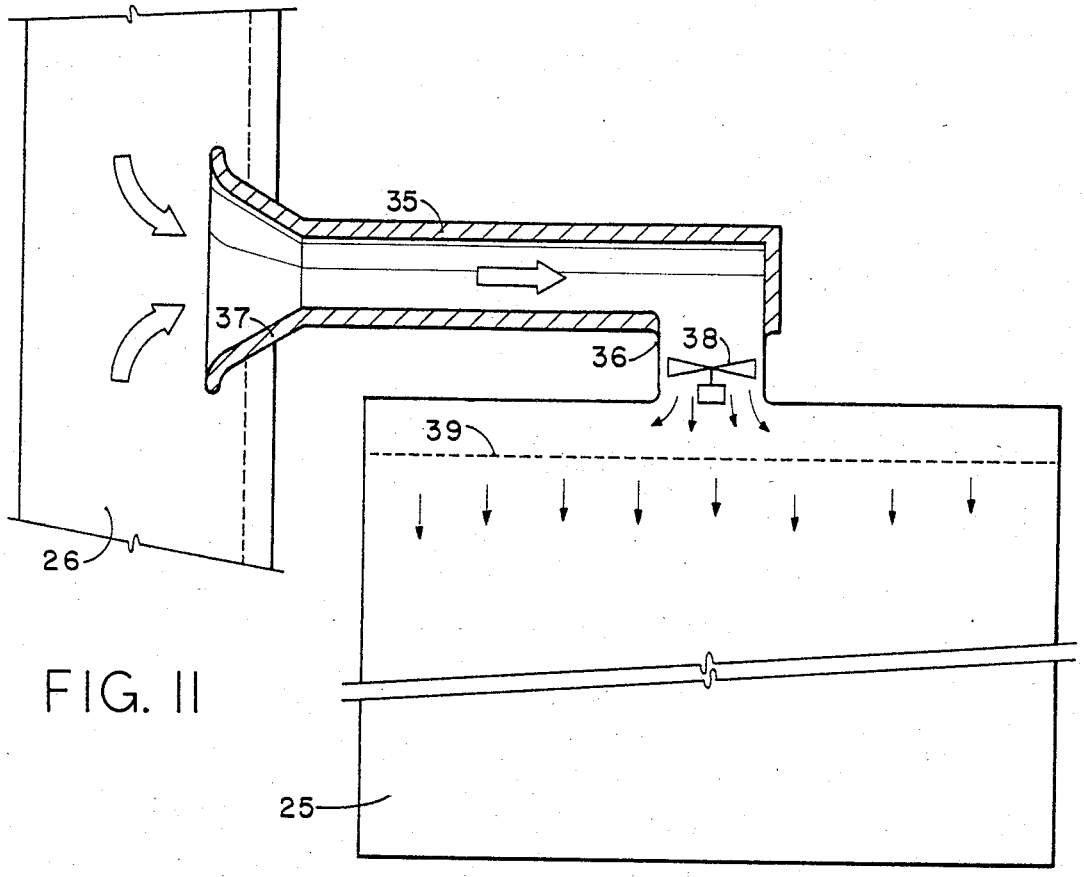
FIG. 11 is a view similar to FIG. 9 of the elevator cab illustrating an alternate embodiment in which a high pressure, high volume blower is provided for supplying air into the cab.
Figure 12:
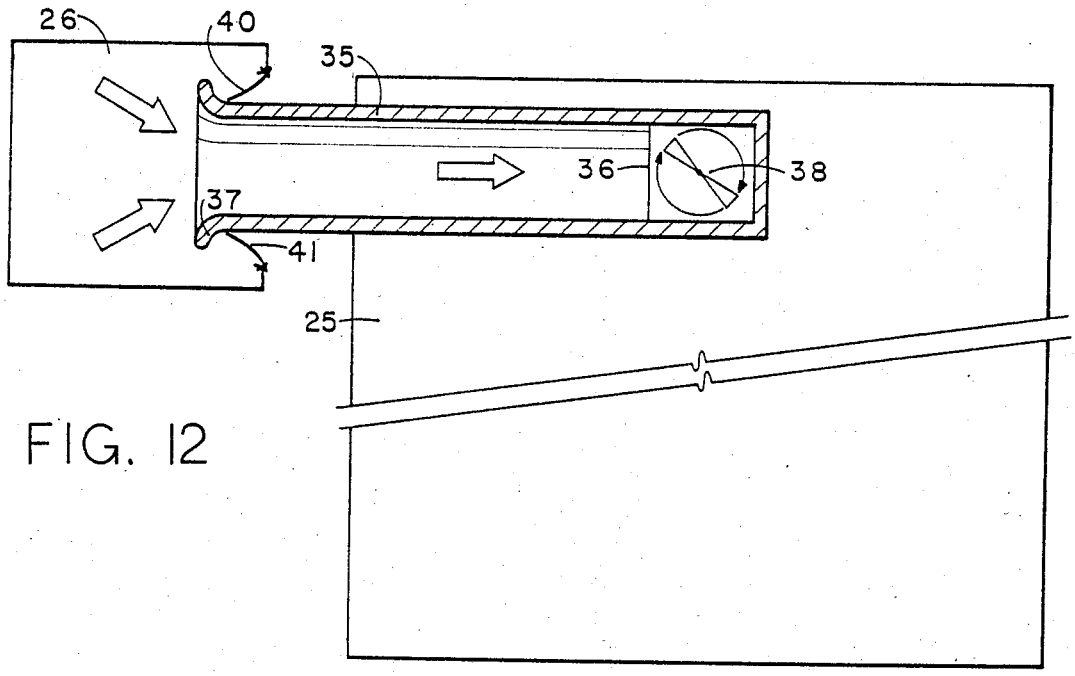
FIG. 12 is a view of the elevator cab similar to FIG. 10 illustrating the relationship of the booster blower to the transfer duct.

In FIGS. 4, 5, and 8–12, the supply air transfer duct 35 is shown in more detail. In fact, the transfer duct 35 is shown in a somewhat exaggerated scale in relation to the cab 25 and the vertical air supply duct 26. In FIGS. 9–10, transfer duct 35 is L-shaped in vertical cross section and has an elbow portion 36 which opens into the top of elevator cab 25 and has bell shaped air inlet portion 37 which extends into vertical air supply duct 26. The elbow portion 36 of transfer duct 35 extends to a circulating fan 38 (FIGS. 11–12) which assists in blowing air into the elevator cab 25 through a conventional ceiling distribution panel 39.

Vertical air supply duct 26 has a vertically extending seal consisting of two separate flexible sealing elements 40 and 41, of rubber, elastomer, impregnated felt, impregnated fiberglas, etc., which extend along the entire length of the air supply duct 26. The sealing elements 40 and 41 are sized to meet each other in sealing relation along the entire vertical length of duct 26 except for the portion into which the bell shaped air inlet portion 37 of transfer duct 35 extends, see FIGS. 4, 5, and 8.

The bell shaped inlet portion 37 of transfer duct 35 is operable to be moved vertically along the entire length of air supply duct 26 with the movement of elevator cab 25 and provides a vertically moveable inlet for supply of air into the elevator cab 25 at any point in its movement from the basement to the top floor.

FIG. 8 illustrates an embodiment having two air supply ducts 26 and two transfer ducts 35 for elevator cab 25. The structure is otherwise substantially the same as previously described. In FIG. 8, there is also shown some of the detail of the relationship of the elevator cab 25 to the lobby and to the hoistway and elevator doors. In FIG. 8, the elevator lobby 42 has a doorway 43 opening into hoistway 17. Hoistway doors 44 and 45 are opened and closed by conventional operating means. Elevator cab 25 is likewise shown with doors 35 and 46 in an open position.

In this view, the flow of air is shown by the directional arrows as providing fresh air under pressure to the interior of elevator cab 25 which air tends to blow outward into elevator lobby on opening of the elevator doors 46 and 47 and hoistway doors 44 and 45 to prevent the intrusion of smoke and flames into the interior of elevator cab 25.

In this embodiment, transfer duct 35 is of a elongated shape as shown in FIGS. 6 and 7. This embodiment of transfer duct 35 has a rectangular base plate 48 connecting it to a like opening on the rear wall of elevator cab 25 and has a bell shaped opening 37 as in the other embodiments shown in FIGS. 9–12. In this embodiment, the air supply is through a pair of transfer ducts 35 which slide up and down a pair of air supply ducts 26.

In FIGS. 9 and 10, there is shown an alternate embodiment of the invention in which transfer duct 35 is connected through a high capacity blower 50 which opens through a diffuser 51 to supply air through air diffuser plate 39 as in the other embodiments of the invention. The blower 50 is of a sufficient capacity to repressurize the fresh air brought in through supply duct 26 to an amount sufficient to maintain the interior of cab 25 under a substantially elevated pressure to prevent intrusion of smoke and fire when the elevator doors 46 and 47 are opened. In this embodiment, transfer duct 35 has a bell shaped outer end portion 37 and is elongated in shape as described for the other embodiments. The supply air duct 26 is provided with a vertically extending seals 40 and 41 in which the bell shaped air inlet opening 37 extends.

OPERATION

The operation of this invention should be fairly evident from the description of the construction and assembly of the various parts. Nevertheless, a more thorough description of operation will be given to facilitate a complete understanding of the invention.

This invention is a system or apparatus which permits the continued operation of elevators during a fire to permit evacuation of occupants from the building and to facilitate the rapid movement of fire department personnel and equipment. The invention consists of a system and apparatus which provides for a continuous ventilation of the hoistway 17 while maintaining the elevator cab 25 thoroughly ventilated with fresh air at a sufficiently elevated pressure to prevent the intrusion of smoke or fire into the cab from the hoistway 17 or from any of the elevator lobbies or floors where fire or smoke might be present.

In normal operation, the supply air blowers 32 provide a positive flow of fresh air, drawn from the exterior of the building through air supply inlets 33, through the hoistway 17 and elevator cab 25 of approximately 35–50 ft./min. to prevent the entry of smoke generated by an early fire condition prior to activation of the emergency smoke removal system. The air supply system may include a cooling or heating section 34 as shown at the top of FIG. 3. This is an optional freature which can be eliminated or can be included at one or more of the air supply levels.

In emergencies, i.e. fire, the air supply fan for the elevator cab 25 and hoistway 17 is automatically operated by the smoke detection and/or fire detection system (not shown) at the high speed operation required to maintain a positive airflow through the cab such that when the doors are opened the outflow will be not less than 200 ft./min. velocity and at a pressure differential of at least 0.1 in. water of the hoistway in relation to the lobby.

The air is drawn from the exterior of the building and introduced by blowers 32 into vertically extending air supply duct 26 which is sealed along its entire length by flexible seals 40 and 41 as described above. The air which exits from supply duct 26 through openings 27 or through leakage around the seals 30 and 41 supplies the hoistway 17 with air to ventilate it for its entire length during normal operation and which serves to keep the hoistway 17 clear of smoke and flames during a fire.

Elevator 25 is moved upwardly and downwardly in hoistway 17 by elevator motor or hoist mechanism 23 which is of conventional construction and operated in a conventional manner. As elevator cab 25 moves up and down shaft or hoistway 17, the transfer ducts 35 move up and down the vertical shaft 26 with the flexible seals 40 and 41 sealing the opening from the supply duct 26 immediately behind and immediately ahead of the transfer duct.

The vertical air supply duct 26 is therefore sealed along its entire length except for the opening into which the transfer duct 35 extends. There may be a slight leakage of air from supply duct 26 through the seals 40 and 41 adjacent to transfer duct 35, but otherwise the duct is sealed through its entire length. Seals 40 and 41 therefore provide a sealed but moveable opening along the entire length which provides introduction of air through transfer duct 35 into the interior of elevator cab 25 as previously described.

This arrangement therefore will maintain cab 25 thoroughly ventilated and at a somewhat elevated pressure relative to the interior of the building, especially the lobby areas where the doors may be opened. The elevated pressure in cab 25 prevents smoke or fire from entering the cab from elevator shaft or hoistway 17. Likewise, when the elevator doors and the hoistway doors are opened at any /given level, the air pressure inside elevator cab 25 causes the air to flow out into the lobby or landing 42 and thus tends to blow the smoke and flames away from the open door of the cab if it has stopped on a level where there is a fire.

While this invention has been described as a system of apparatus permitting the use of elevators during a fire, it is also a general purpose system of supplying air to an elevator cab to permit its operation in an unsafe air environment. For example, the system and apparatus could be installed in a mine shaft to provide fresh air to an elevator cab which has to move through unsafe air conditions, such as layers or zones of noxious gases or fumes.

While this invention has been described fully and completely with special interest upon certain preferred embodiments, it should be understood, that within the scope of the appended claims, the invention may be practiced otherwise than as specifically described herein.

I claim:

1. A smoke and fire protection system for elevators comprising, in combination a multistory building having an elevator hoistway therein, said elevator hoistway being enclosed at the top to prevent discharge of smoke therethrough, an elevator cab positioned in said hoistway for movement vertically therein, means for moving said elevator cab, duct means separate from and positioned in said hoistway, having an intake outside said building for introduction of fresh air, and connected to said elevator cab throughout the entire range of vertical movement thereof, and including a plurality of openings along said duct means into said hoistway, to supply fresh air separately to said hoistway and to said elevator cab, and ventilating means connected to said duct means to supply fresh air thereto to pressurize and supply fresh air separately to said hoistway and said elevator cab.

2. A smoke and fire protection system for elevators in accordance with claim 1 in which said ventilating means comprises a blower connected to the exterior of the building to draw in fresh air from outside said building and connected to said duct means to supply fresh air to said elevator cab throughout its entire range of vertical movement.

3. A smoke and fire protection system for elevators in accordance with claim 1 in which said ventilating means includes means for conditioning the air supplied therethrough.

4. A smoke and fire protection system for elevators in accordance with claim 1 in which said duct means includes a duct extending vertically in said elevator hoistway and means flexibly connecting said duct to said elevator cab to maintain communication therewith throughout its entire range of vertical movement.

5. A smoke and fire protection system for elevators in accordance with claim 4 in which said duct has an opening along one side thereof extending for substantially the entire height of said elevator hoistway, means sealing said duct extended opening, and means comprising a duct supported on said elevator cab and opening thereinto and extending through said duct opening sealing means for movement along the length of said duct opening to conduct fresh air into said elevator cab and to introduce fresh air into said hoist way along the entire length thereof.

6. A smoke and fire protection system for elevators in accordance with claim 1 in which elevator cab duct includes blower means supported thereon in addition to said ventilating means for inducting air therethrough at high volume.

7. A smoke and fire protection system for elevators in accordance with claim 5 in which said sealing means comprises a pair of elongated strips of flexible sealing material secured along each edge of said elongated opening and meeting in sealing relation, and said elevator cab duct is of elongated cross section and bell shaped and fits through said said sealing strips at the point of contact therebetween and is movable with said elevator cab along the length of said elongated opening with said sealing strips maintaining sealing relation ahead of and behind said elongated bell shaped portion.

8. A smoke and fire protection system for elevators in accordance with claim 1 in which said building includes doorways and doors opening into said elevator hoistway at separate stories in the building, said elevator includes a doorway and doors operable to open at said hoistway doorways, and said ventilating means comprises blower means with an intake outside said building operable to supply fresh air at a volume and pressure sufficient to ventilate said elevator cab and to effect a substantial outflow of air therefrom on opening said elevator and hoistway doors.

9. A smoke and fire protection system for elevators in accordance with claim 1 in which said duct means includes a pair of ducts extending vertically in said elevator hoistway, with separate intakes outside said building, and separate means flexibly connecting said ducts to said elevator cab to maintain communication therewith throughout its entire range of vertical movement.

10. A method of protecting an elevator cab in a building, positioned in an elongated elevator hoistway for vertical movement therein, against fire, smoke, or poisonous fumes or gases comprising introducing fresh air from an intake outside said building through a duct at high volume and positive pressure into said elevator cab and separately from said duct through a plurality of openings along said duct into said hoistway to ventilate the same and maintain a positive pressure therein sufficient to effect a continuous outflow of air when the doors are opened to blow fire, smoke, or poison fumes or gases away and to prevent the intrusion of smoke or poison fumes or gases when the doors are closed.

11. A method of protecting elevators according to claim 10 in which said fresh air is introduced into said cab continuously along the entire range of vertical movement thereof.

12. A method of protecting elevators according to claim 11 in which said fresh air is introduced through duct means separate from and positioned in the elevator hoistway, having an intake outside said building, and connected to said elevator cab throughout the entire range of vertical movement thereof, and supplied by ventilating means connected to said duct means.

13. A method of protecting elevators according to claim 11 in which said fresh air is introduced through a duct extending vertically in said elevator hoistway and flexibly connected to said elevator cab to maintain communication therewith throughout its entire range of vertical movement 14. A method of protecting elevators according to claim 13 in which said duct has an opening along one side thereof extending for substantially the entire height of said elevator hoistway, means sealing said duct extended opening, and said flexible connection comprises a duct supported on said elevator cab and opening thereinto and extending through said duct opening sealing means for movement along the length of said duct opening to conduct fresh air into said elevator cab and to introduce fresh air into said hoist way along the entire length thereof.

15. A method of protecting elevators according to claim 14 in which said duct opening sealing means comprises a pair of elongated strips of elastomeric sealing material secured along each edge of said elongated opening and meeting in sealing relation, and said elevator cab duct is of elongated cross section and bell shaped and fits through said said sealing strips at the point of contact therebetween and is movable with said elevator cab along the length of said elongated opening with said sealing strips maintaining sealing relation ahead of and behind said elongated bell shaped portion.

* * * * *